US010382856B2

(12) United States Patent
Kucharko

(10) Patent No.: US 10,382,856 B2
(45) Date of Patent: Aug. 13, 2019

(54) ELECTRICAL DEVICE COMPRISING AN EARPHONE

(71) Applicant: Jerzy Franciszek Kucharko, Vienna (AT)

(72) Inventor: Jerzy Franciszek Kucharko, Vienna (AT)

( * ) Notice: Subject to any disclaimer, the term of this patent is extended or adjusted under 35 U.S.C. 154(b) by 0 days.

(21) Appl. No.: 15/777,826

(22) PCT Filed: Nov. 22, 2016

(86) PCT No.: PCT/AT2016/000097

§ 371 (c)(1),
(2) Date: May 21, 2018

(87) PCT Pub. No.: WO2017/087999

PCT Pub. Date: Jun. 1, 2017

(65) Prior Publication Data

US 2018/0352316 A1 Dec. 6, 2018

(30) Foreign Application Priority Data

Nov. 23, 2015 (AT) ..... A 754/2015
Nov. 23, 2015 (AT) ..... A 755/2015

(51) Int. Cl.
*H04R 1/10* (2006.01)

(52) U.S. Cl.
CPC ..... *H04R 1/105* (2013.01); *H04R 1/1041* (2013.01); *A61H 2205/027* (2013.01); *H04R 2201/107* (2013.01)

(58) Field of Classification Search
CPC .. H04R 1/1055; H04R 1/1066; H04R 1/1075; H04R 2201/107; A61H 2205/0277
See application file for complete search history.

(56) References Cited

U.S. PATENT DOCUMENTS 5,222,151 A 6/1993 Nagayoshi et al.
5,662,679 A 9/1997 Voss et al.
9,967,643 B2 5/2018 Hirano
(Continued)

FOREIGN PATENT DOCUMENTS

DE 423875 1/1926
DE 3328100 7/1984
(Continued)

OTHER PUBLICATIONS

International Search Report for PCT/AT2016/000097, English Translation attached to original, Both completed by the European Patent Office on Mar. 14, 2017, All together 7 Pages.

*Primary Examiner* — Sunita Joshi
(74) *Attorney, Agent, or Firm* — Brooks Kushman P.C.

(57) ABSTRACT

A device having an earphone is provided to be attached to the tragus of the outer ear of a person, wherein two levers held to one another in a pivotal manner from opposite sides, driven by an elastically preloaded part, press onto the tragus. The levers both have two arms, wherein the pivot axis is at a distance from the ends of the two levers in the longitudinal direction of the lever and lies outside the normal projection towards the surface of the tragus when the device is attached as intended to the tragus, and/or the elastically preloaded part is a pre-curved bending spring which is pre-curved by more than 360°.

11 Claims, 10 Drawing Sheets

(56) References Cited

U.S. PATENT DOCUMENTS

| | | | | |
|---|---|---|---|---|
| 2008/0025539 | A1 | 1/2008 | Bailey et al. | |
| 2009/0123000 | A1* | 5/2009 | Wright | H04R 1/105 381/59 |
| 2010/0114153 | A1 | 5/2010 | Kretz et al. | |
| 2012/0039500 | A1* | 2/2012 | Silvestri | H04R 1/1016 381/380 |

FOREIGN PATENT DOCUMENTS

| | | |
|---|---|---|
| EP | 2456228 | 5/2012 |
| GB | 720072 | 12/1954 |
| JP | H05300207 | 11/1993 |
| JP | H09294296 | 11/1997 |
| JP | 2003264882 | 9/2003 |
| WO | 2012021424 | 2/2012 |
| WO | 2013007860 | 1/2013 |
| WO | 2015162913 | 10/2015 |

* cited by examiner

ELECTRICAL DEVICE COMPRISING AN EARPHONE

CROSS-REFERENCE TO RELATED APPLICATIONS

This application is the U.S. national phase of PCT Application No. PCT/AT2016/000097 filed on Nov. 22, 2016, which claims priority to AT Patent Application No. A 754/2015 filed on Nov. 23, 2015, and AT Patent Application No. A 755/2015 filed on Nov. 23, 2015, the disclosures of which are incorporated in their entirety by reference herein.

The invention relates to an electrical device comprising an earphone.

An earphone within the meaning of this document is an electrically operated device which is intended to be secured directly on the outer part of the human ear such that it at least protrudes into the auricle, and which in a controlled manner can generate sound that is intended to be clearly heard by the ear on which the device is secured. An earphone is typically connected either by cable or by radio (i.e. wirelessly) to a further device such as a telephone or a device for playing music, and it receives from said device the information that is to be acoustically reproduced. A device comprising an earphone can for example also be a hearing device, i.e. a hearing aid, which serves to compensate for a hearing impairment of an ear by amplifying presently incoming sounds from the environment in relevant frequency ranges directly at the auditory canal. An earphone, however, can also for example be part of what is called a headset, i.e. a device which, in addition to having a loudspeaker, also contains a microphone and exchanges information signifying sound in the form of electromagnetic signals by cable or wirelessly with a device arranged at a distance.

Essential functional aspects of devices that comprise an earphone concern the way in which they are secured on the human ear. In this connection, some prior art is set out here:

DE 423875 C, published as early as 1924, discloses an electrical device which comprises an earphone and which is provided for use with a telephone. The outer shape of the device roughly approximates to that of a rigid U or V, wherein an opening is located at the free end face of one branch and leads to a small loudspeaker located within the branch. This branch is intended to be inserted, with the free end face to the front, slightly into the external auditory canal of the human ear, specifically such that the tragus (a small and flattish mass of cartilage at the front region of the boundary around the entrance to the external auditory canal of the human ear) is clamped between the two branches. To be able to adapt the clamping action, a small two-armed lever is secured pivotably on the side of the outer branch facing toward the tragus, which lever is intended to be pivoted by a prestressed spring such that one arm of the lever is pressed onto the tragus. To be able to adapt the earphone to different tragus thicknesses, the bearing of the lever on the associated branch is displaceable and releasably fixable. On account of the confined space, the lever is only very poorly accessible when the earphone is fitted, with the result that, if the earphone is to hold firmly on the ear, the removal of the earphone is difficult and may also be painful.

DE 3328100 A1 (published 1984) discloses an electrical device which serves as a hearing device and which has a microphone, a loudspeaker, a battery and an electronic amplifier circuit. In its intended use, it picks up ambient noises with the microphone and reproduces part of the frequency spectrum of these noises in amplified form instantly at the loudspeaker. In order to secure it to the ear, the device is clamped firmly on the earlobe, and it is optionally held in addition by a bow extending around the outside of the outer ear. Most of the weight of the device is located at the level of the earlobe; protruding from this heavy part is an arm, at the end of which a loudspeaker opening is located, at or in the entrance region to the external auditory canal, without closing the latter. In a design variant of the device, the clip with the aid of which the earlobe is to be clamped is configured as a pair of two-armed levers which are held pivotably on each other, wherein the two levers can be pressed by a snap-action mechanism relative to each other alternately into one of two possible end positions.

U.S. Pat. No. 5,222,151 A and JP 9294296 A disclose earphones of a form that is common nowadays. The housing, having the approximate shape of a circular disk, is placed in the auricle within the region lying between tragus and antitragus, wherein the disk plane is oriented approximately vertically. (The antitragus is a small mass of cartilage at the posterior lower region of the boundary of the entrance to the external auditory canal). From the outer end face of the disk, a cable sleeve protrudes downward approximately parallel to the disk plane and approximately parallel to the gap between tragus and antitragus. The earphone is held in place especially by its own weight, i.e. it requires hardly any clamping force, which is a convenience in itself. A disadvantage is that the earphone easily falls out during sports activities, etc., and that, if it is fitted well, it closes the external auditory canal. Disadvantages associated with this closure are that ambient noises are not heard and there is an unpleasant microclimate in the external auditory canal. In the design according to JP 9294296 A, the earphone is equipped with an additional surface which bears on the outside of the lower parts of tragus and antitragus and, if suitably dimensioned, slightly improves the fit of the earphone.

The publications WO 2013007860 A1, WO 2012021424 A1, US 2008/0025539 A1 and JP2003264882 A disclose devices with earphones whose outer shape is at least in part approximately U-shaped, wherein the two branches of the U are expansible by elastic deformation. When fitted as intended, the device is held on the ear by means of the tragus being clamped between the two branches, which are spread slightly apart by elastic prestressing. The sound source is located on the inner of the two branches; in many designs this sound source is a customary loudspeaker; in other designs it is an actuator, which directly acts mechanically on the tragus and whose surface is set in vibrations, as a result of which sound perception is generated in the ear. In the design according to the aforementioned JP2003264882 A, in addition to the fixing provided by clamping on the tragus, fixing is provided by a bow extending around the outer ear. An advantage of the fixing provided by clamping of the tragus is that the auditory canal does not need to be closed and that a relatively secure fit on the ear is possible.

A disadvantage of the disclosed designs is in particular that fitting the device on the tragus is a difficult procedure that requires some dexterity. If the tragus is relatively thick, and therefore quite a considerable force is needed in order to spread apart the branches between which the tragus has to be clamped, then pushing the device onto the tragus can also cause pain. If the device is designed such that in any case said force is not so high as to cause pain, then said force may be too low in the case of a thin tragus, with the result that the device does not sit securely.

US 2010114153 A1 and U.S. Pat. No. 5,662,679 A (published 1997) disclose acupressure clips for clamping the tragus. Acupressure is a therapeutic method in which a dull, sometimes also quite painful pressure is exerted on a part of the body over a certain period of time. The clips according to US 2010114153 A1 and U.S. Pat. No. 5,662,679 A each consist of two two-armed levers and an approximately U-shaped connecting bow. The elastically flexible connecting bow is integrally connected at a respective branch end to approximately the longitudinal center of in each case one two-armed lever. Movement toward each other (by pressure) of two mutually mirror-symmetrical lever ends of both two-armed levers causes a spreading apart of the remaining two lever ends. In this way, the acupressure clip can be clipped onto the tragus in the manner of a very short clothes peg. The force exerted on the tragus by the clamped-on clip is largely dependent on how thick the tragus is.

The object of the invention is to make available a device comprising an earphone, which device is to be secured on a human ear by being clipped onto the tragus, such that it is pressed with one lever onto the tragus from the inside and presses with a second lever onto the tragus from the outside.

Compared to already known designs of devices comprising an earphone, the new device to be made available is intended to be better in the sense that its application and removal are easier and at any rate free of pain, and in the sense that the device nonetheless remains reliably fitted on the tragus, irrespective of how thick the tragus is. Additional advantages are that the device can if necessary be clipped comfortably, safely and without destruction onto locations other than the tragus, for example onto another part of the auricle or onto part of an item of human clothing, or onto a part on which the device is intended to be fixed for storage purposes when not in use.

The object is achieved starting from a design in which the following features known per se are realized:

- The device comprising an earphone has two levers which are connected to each other pivotably.
- With the device mounted as intended on the tragus, a region of one lever lying remote from the common pivot axis bears on the inner face of the tragus, and a region of the second lever lying remote from the common pivot axis bears on the outer face of the tragus.
- An elastically prestressed part is in engagement with both levers and, on account of its elastic prestressing force, causes a torque between the two levers about the common pivot axis, such that those two lever regions which bear on the tragus from opposite sides, when the device is mounted as intended on the tragus, are moved toward each other in the absence of other forces.

The inventive improvement to these known features comprises two features, which are ideally used in combination with each other, but with which the object of the invention can also be achieved when they are each used alone.

The first of these two features is that the two levers are each designed with two arms, wherein the pivot axis lies at a distance from the ends of both levers in a respective longitudinal direction of the levers, and the pivot axis moreover lies outside the normal projection onto the surface of the tragus when the device is fitted as intended on an ear.

This design has the effect that, through the pivoting of the two remaining lever arms toward each other, those lever arms between which the tragus is intended to be clamped are pivoted away from each other. The procedures of fitting the device and removing it from the tragus, and if necessary of adjusting the device on the tragus, can therefore be carried out very easily and indeed entirely intuitively. It is therefore also not necessary for a lever arm to bear with pressure on the tragus during these procedures. Thus, when adjusting the position of the device on the tragus, it is possible to suppress any rubbing and therefore also any pain on the tragus.

The second of said two features is that the elastically prestressed part, which causes a torque between the two levers about the common pivot axis, is designed and arranged as a bending spring, which is pre-curved by more than 360°.

The term "bending spring" in this document signifies an elastic spring which is made of an elastic material and which, at two clamping points, is intended to be in contact with two other parts (in the present case the two mutually pivotable levers), wherein these two other parts are movable relative to each other in a guided manner, and the associated movement of the clamping points causes an increase or decrease of elastic bending deformation of the spring. The adjective "pre-curved" in this context signifies that the bending spring is made of an elongate or flat material which, in relation to its state when stretched straight out, is plastically pre-curved about the axis of the intended elastic bending deformation.

The invention is explained with reference to drawings:

FIG. 1 is a sketch of the left outer ear 1 of a human, looking at it laterally from the front. To make the explanation of terms easier, the parts are identified by reference numbers as follows: tragus 2, tragus margin 3, cavum conchae 4, and inlet region 5 of the auditory canal.

Figure 2:
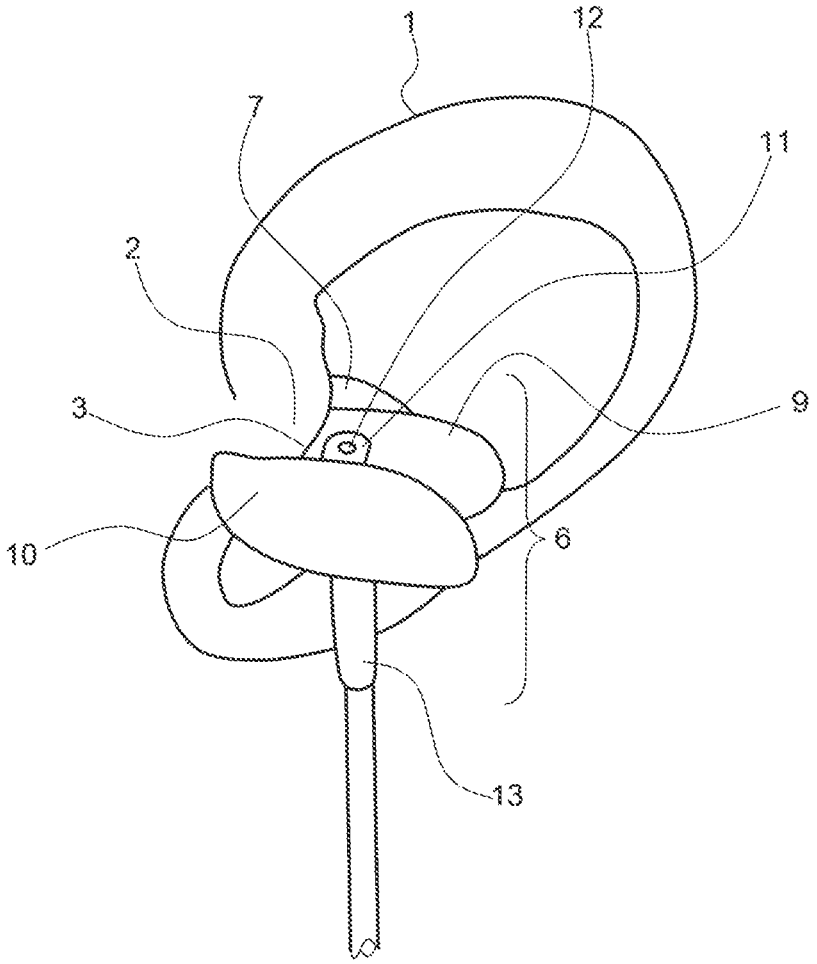
FIG. 2 shows an example of a device 6 according to the invention, which device 6 is clipped in the intended manner onto a left ear of a human. The viewing direction is laterally from the front and above.

According to FIG. 2, a device 6 according to the invention is clipped securely on the tragus 2 of the outer ear 1.

Figure 1:
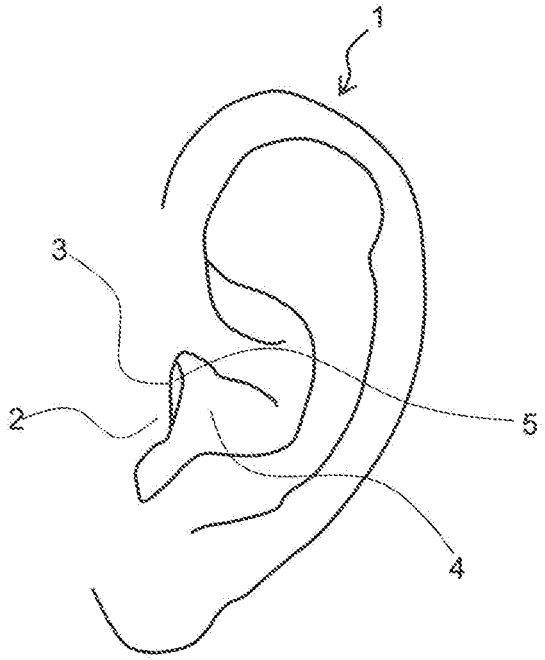

The device 6 has a housing 7 which is situated in the cavum conchae 4 (FIG. 1) and in the region of the inlet 5 (FIG. 1) to the external auditory canal and bears on the inner face of the tragus 2.

The housing 7 accommodates among other things a loudspeaker for which the associated loudspeaker opening 8 (FIG. 4) is located on that side of the housing 7 which, with the device 6 fitted as intended on the tragus 2, points into the external auditory canal of the associated ear.

A planar lever 9 is formed in one piece with the housing 7 and, when the device 6 is fitted as intended on the tragus 2, the lever 9 lies approximately parallel to the plane of the tragus 2, on the inner side of this plane, and, starting from the tragus 2, protrudes rearward past the tragus margin 3 ("rearward" as seen from the person wearing the device 6).

Another planar lever 10 is also oriented approximately parallel to the plane of the tragus 2 and bears on the outer face of the tragus 2.

At an end region lying remote from the respective lever ends, planar bearing lugs 11 oriented parallel to each other protrude from the two levers 9, 10. The bearing lugs 11 are each provided with a through-bore, wherein all the through-bores are flush with one another, and a circular cylindrical bearing shaft, which forms the pivot axis 12 between the levers 9, 10, extends through the through-bores. At least one of the two levers 9, 10 is pivotable about the pivot axis 12.

Figure 4:
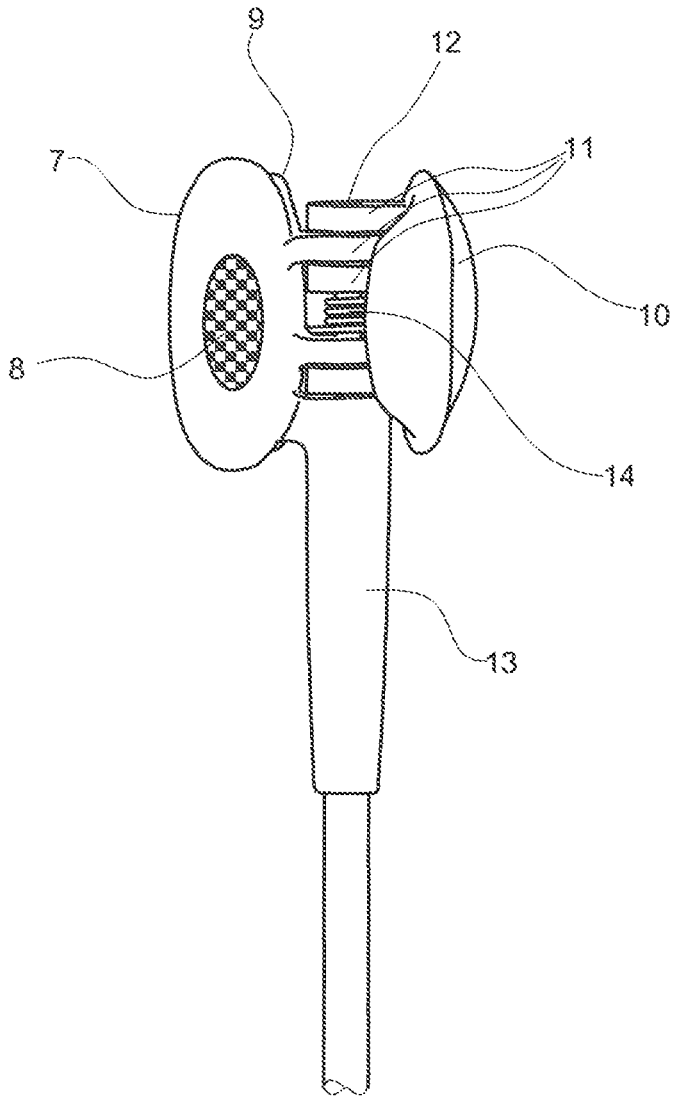
FIG. 4 shows the device of FIG. 2 and FIG. 3 only from the front.

Arranged approximately flush with the pivot axis 12 and downward (in the intended fitting), a cable sleeve 13 is integrally formed on the housing 7, through which cable sleeve 13 a cable runs into the housing 7 (see also FIG. 4).

Figure 3:
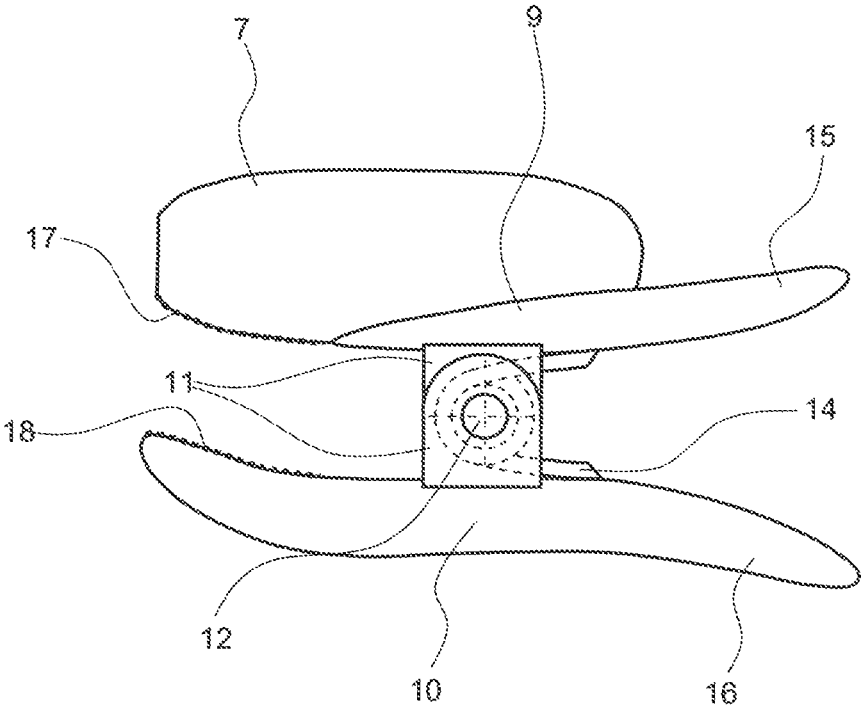
FIG. 3 shows the device of FIG. 2 only from above.

As can be seen from FIG. 3 and FIG. 4, the pivot axis 12 is enclosed not only by the bearing lugs 11 but also by the helically shaped central part of an elastically prestressed part 14 configured as a bending spring.

The two branches of the elastically deformable part 14, i.e. the wire ends of the bending spring that protrude from the central helically shaped part, are elastically prestressed and press on a respective lever 9, 10, specifically in each case on that lever arm 15, 16 which, with the device 6 fitted as intended on the tragus 7, is directed away from the tragus 2 and not directed toward it, as seen from the pivot axis 12.

Since the branches bear with pressure on said lever arms 15, 16, this means that the two levers 9, 10, in the absence of other forces, are pivoted such that the lever arms of the levers 9, 10 lying opposite the lever arms 15, 16, and having the intended regions of contact 17, 18 with the tragus 2, are pivoted toward each other until they either bear on each other or bear, from opposite sides, on a part (typically the tragus 2) lying between the two levers. The relative position of the levers 9, 10 shown in FIG. 3 and FIG. 4 to each other can only be held stable by them either if the two lever arms 15, 16 are pressed toward each other by an external action (not shown) or if the two levers 9, 10 with the two regions of contact 17, 18 bear from opposite sides on an object arranged between these regions of contact.

At least intermittently during the possible pivoting movements of the levers 9, 10, the rectilinear continuations (parallel to the image plane in FIG. 3 and thus normal to the pivot axis 12) of the intended regions of contact 17, 18 of the levers 9, 10 with the tragus 2 extend on opposite sides relative to the pivot axis 12, i.e. enclose the axis of the pivoting movement of the levers 9, 10 between them. This means that, with the device 6 fitted as intended on a tragus 2, the pivot axis 12 about which the two levers 9, 10 are pivotable relative to each other necessarily lies outside the normal projection onto the surface of the tragus 2.

In the configurations according to FIG. 2 to FIG. 7, the pivot axis 12, 25, 26 about which the two levers are pivotable relative to each other lies in each case in front of the margin 3 of the tragus 2 in the region of the cavum conchae 4. (The cavum conchae 4 is a shell-like depression which externally adjoins the auditory canal). This arrangement results in particularly simple and particularly intuitive handling. The effect is heightened by the fact that the pivot axis 12, 25, 26 is oriented approximately parallel to the tragus margin 3.

The bearing surfaces of the levers 9, 10 on the tragus 2 can be readily dimensioned such that they are of the order of magnitude of 0.5 square centimeters. With this bearing surface, a pressing force of 0.3 N (which easily suffices to hold the device on the tragus according to considerations set out below) is just enough to be clearly perceptible, at least immediately after the build-up of force. In no case is it so great as to be felt painful.

If the surface of the regions of contact 17, 18 is configured to be rough, for example ribbed, its coefficient of friction in relation to human skin is increased by comparison with a smooth configuration. It is then still possible to manage with a much lesser pressing force of the levers 9, 10 on the tragus 2.

To achieve a good fit of the regions of contact 17, 18 on the tragus 2, it is advisable to adapt the shape of the regions of contact 17, 18 at least approximately to the anatomical shape of the tragus 2.

To ensure that a tight fit is equally possible on a thicker and on a thinner tragus 2, it is important that the distance between the pivot axis 12, 25, 26 of the levers 9, 10 and the center of the regions of contact 17, is at least approximately one centimeter. If this distance were to be much less, then, in the case of an extremely thin tragus or an extremely thick tragus, the regions of contact 17, 18 could bear on the tragus 2 at an excessively obtuse angle and therefore with an undesirably small contact surface area.

Since the pivotable levers 9, 10 are configured according to the invention with two arms, the advantage over a configuration with one-armed levers is that, in order to apply and release the device 6 to and from the tragus 2, the lever arms 15, 16 facing away from the tragus 2 only have to be pressed toward each other in order to open the clamping region between the levers 9 and 10. It is therefore not necessary, when adjusting the position of the device 6 on the tragus 2, that a lever 9, 10 presses on the tragus 2 and causes pain on account of rubbing.

In order to avoid the accumulation of dirt and the build-up of sweat there, the device parts (elastically prestressed part 14, 24, 27, 31, bearing lugs 11, bearing pin) located in the region of the mechanical connection between the two levers can be configured at the surface in such a way as to repel dirt and moisture, in technical terms to be hydrophobic (water-repellent) and at least not lipophilic but as far as possible lipophobic (fat-repellent). Suitable materials for these purposes, either for a coating or as a complete part are known to be fluorocarbons (e.g. PTFE) and silicones.

As an alternative to this, said region can also be molded or encapsulated with a composition that cures to provide a permanently flexible foam. Materials suitable for this purpose are organic plastics and once again silicones.

Figure 5:
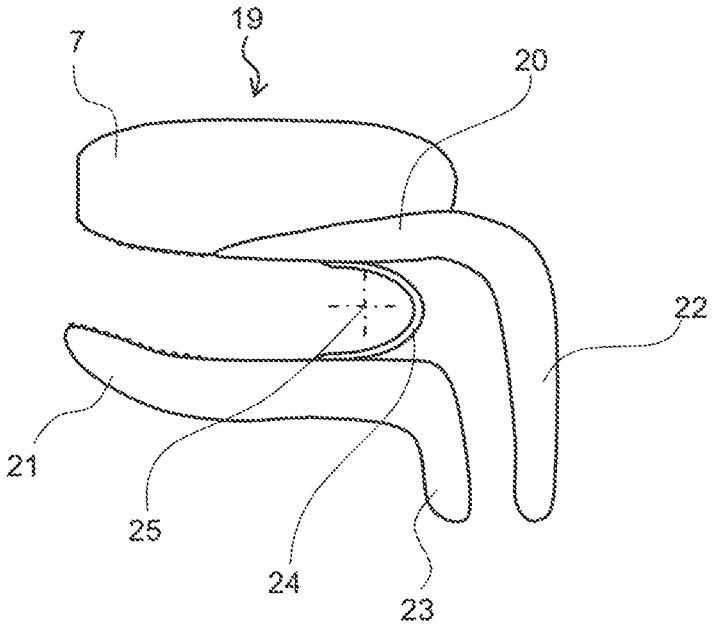
FIG. 5 shows a second example of a device 19 according to the invention, only from above.
Figure 6:
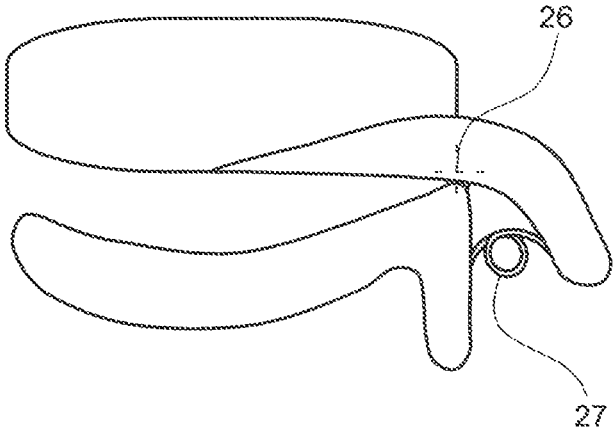
FIG. 6 shows a third example of a device 19 according to the invention, only from above.

FIG. 5 shows a sketch of a device 19 according to the invention, which differs in two points from the device according to the invention shown in FIG. 2 to FIG. 4:

The arms of the two-armed levers 20, 21 are substantially not straight, and instead each of these arms 20, 21 is curved by approximately 90° about axes lying parallel to the pivot axis 25. The curvature is oriented such that the lever arms 22, 23 to be arranged facing away from the tragus 2, in the plane lying normal to the pivot axis 25, protrude outward from the plane of the cavum conchae 4 when the device 19 is fitted as intended on the tragus 2. It may perhaps be more difficult to achieve as pleasing an appearance as with the device 6 sketched in FIG. 2 to FIG. 4, but it is possible here to achieve better handling during fitting, adjustment and removal of the device 19 on the tragus 2.

In the case shown in FIG. 5, the elastic part 24 applying a diametrically opposite torque to the two two-armed levers 20, 21 held pivotably on each other is not a separate part separated by the levers 20, 21. Instead, the elastic part 24 is molten in one piece with both levers 20, 21. It is configured such that it can easily bend about the intended pivot axis 25 between the two two-armed levers 20, 21. As shown schematically, it can for example have the configuration of a bent leaf, wherein all the bending axes lie parallel to the intended pivot axis 25.

However, it would also be possible to use as elastic part 24 a part made of a soft rubber-like material, such as silicone, or of a foamed elastic polymer. Such a part could serve as a tension spring, compression spring or bending spring between the mutually pivotable levers 20, 21, or also as a (single) connection part between these.

A device 6, 19 according to the invention can be provided with an off switch which is actuatable automatically by virtue of the fact that the levers 9, 10 and 20, 21 are pivoted toward each other in such a way that the intended regions of contact with the tragus 2 almost touch or completely touch. The device is thus automatically switched off when it is removed from the tragus 2 and let go or clipped onto a very thin storage strip. In addition to the added comfort, it is possible especially in the case of battery-operated devices to achieve important energy savings. The off switch can be, for example, a mechanical switch whose contacts are pivoted along with said levers. However, it can also be, for example, an optical, capacitive or inductive proximity sensor, which detects the distance of regions of the two levers 9, 10 and 20, 21 from each other and switches accordingly when fixed threshold values are exceeded or not reached.

It must be made clear that the elastically prestressed part that applies the necessary driving force for the pivoting movement of the levers relative to each other does not necessarily have to extend about the pivot axis of the pivoting movement of the mutually pivotable levers. It can also lie wholly on a single side radially next to the pivot axis. A configuration of this kind is shown schematically in FIG. 6. The two two-armed levers are held on each other in such a way as to be pivotable about the pivot axis 26. The elastically prestressed part 27 configured as a bending spring, which acts on the two levers by a pressing force, is arranged on one side radially next to the pivot axis 26, without enclosing the pivot axis 26.

If the device according to the invention, which comprises an earphone, has an electrical accumulator, i.e. a repeatedly rechargeable battery, as energy reservoir, it is expedient, in an advantageous further development of the invention, if the charger, used for charging the accumulator, and the device comprising an earphone are designed so as to be coordinated with each other such that the electrical connections required for the charging between the device, which comprises an earphone, and the charger can be established by the first device being clipped onto a region of the charger just as it is otherwise clipped onto a tragus. For this purpose, the charger requires an extension piece which can be clamped between the two regions of the to be moved toward each other by the elastically prestressed part and which has electrical contacts on the surfaces that then come into contact with these levers. The corresponding charging contacts are to be applied to the then touching surfaces of the levers.

Earphones of the type according to the invention can be easily fitted not just on the tragus 2 of an ear, they can be equally well fitted to an item of clothing, for example the collar of a shirt or sports jacket or the upper edge of a shirt pocket.

Further detail is given below of the feature according to the invention whereby the elastically prestressed part, causing a torque between the two levers about the common pivot axis, is designed and arranged as a bending spring which is pre-curved by more than 360°.

In the device according to FIG. 3 and FIG. 4, the elastically prestressed part 14 is designed as a bending spring with a central, helically shaped part. If the number of windings of the central helically shaped part is increased, while other conditions remain the same (wire thickness, diameter of the windings, length of the branches), the essential effect is that the spring characteristic becomes flatter and the range of the possible elastic deformation path becomes greater.

As can be seen symbolically in FIG. 4, the central helically shaped part of the elastically prestressed part 14 designed as a bending spring has approximately four and a half windings, i.e. an angle of curvature of approximately 1600 angular degrees. The two branches of the elastically prestressed part 14 bear on the two-armed levers 9, 10 (FIG. 3) and either pivot these or are pivoted by them as appropriate. The maximum range within which the levers 9, 10 are ever pivoted during normal function amounts to a maximum of approximately 40 angular degrees, i.e. only about one fortieth of the angle by which the elastically prestressed part 14 as bending spring is plastically and elastically pre-curved. It is thus very simple for a person skilled in the art to design and arrange the elastically prestressed part 14 such that the force with which it presses with its branches on the levers 9, 10, on account of its elasticity, maintains an almost constant ideal value over the whole of the possible pivot range of the levers 9, 10.

Figure 8:
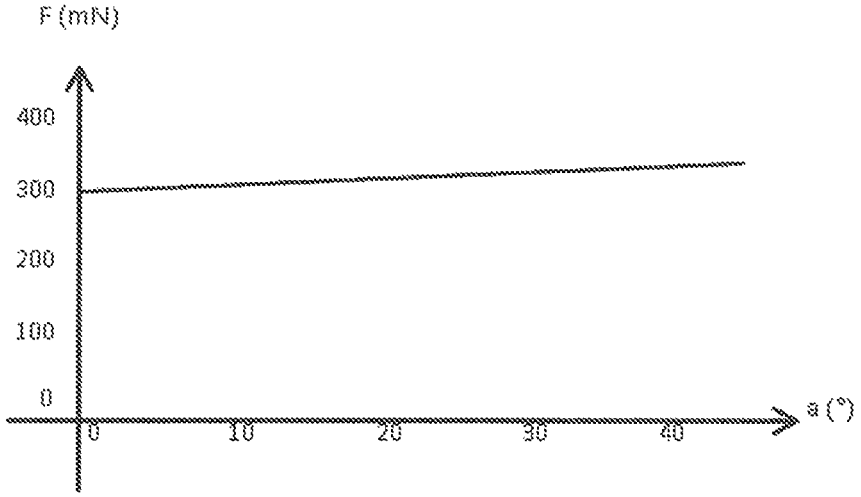
FIG. 8 is a diagram showing the clamping force of the levers, brought about on account of the bending spring, as a function of the pivot angle of the levers.

This relationship is illustrated in the diagram according to FIG. 8. The abscissa value describes the angle a about which the two levers 9, 10 are pivoted in the opening direction. At the angle a=0, the regions of contact 17, bear on each other. The greater the angle a, the further the region of contact 17, intended to bear on the inner face of the tragus 2, and the region of contact 18, intended to bear on the outer face of the tragus 2, are pivoted away from each other. The ordinate value describes which force is exerted by the regions of contact 17, 18 onto a body clamped between them, if a torque is introduced onto the levers 9, 10 only by the branches of the elastically prestressed part 14 designed as a bending spring. The force profile over the angle a is substantially linear and it is very flat in the considered range. That is to say, between the minimal and maximal angle of opening, the level of the force F changes by only a few percentage points. In other words, in ears with a very thick tragus 2, the pressing force exerted by the levers 9, 10 is de facto the same as in ears in which the tragus 2 is very thin.

Thus, independently of the thickness of the tragus 2, the pressing force F can be precisely adjusted such that, even though the device 6 is held securely, no undesirably high pressing force occurs on the tragus 2. Good results are obtained if the force F is approximately three times the weight of the device 6. For example, a device usable as a telephone part, and containing loudspeaker, microphone, Bluetooth transmitter/receiver unit, further electronics and battery, typically has a mass of approximately 10 grams. A weight of approximately 0.1 N thus acts on it. The device on the tragus 2 is already held very well against this weight if the force F with which each of the two pivotable levers 9, 10 presses onto the tragus 2 is only 0.3 N.

The bearing surfaces of the levers 9, 10 on the tragus 2 can easily be dimensioned such that they are of the order of magnitude of 0.5 square centimeters. With this bearing surface, a pressing force of 0.3 N is just enough to be clearly felt, at least immediately after the build-up of force. In no case is it so great as to be felt painful.

A pre-curvature of the elastically prestressed part 14, configured as a bending spring and shown schematically in FIG. 4, about more than four complete revolutions leads to very easily observable requirements in terms of material properties and other dimensions of this part 14. In relation to the known designs of devices in which the part 14 to be seen as a bending spring is pre-curved only about half a revolution, a marked improvement can be achieved if the pre-curvature of the bending spring amounts to more than 360°. Since the branches protrude from the central helically shaped part approximately parallel to each other and in the same direction, one and a half revolutions are particularly advantageous.

If, with the same choice of material for the bending spring and with the same wearing comfort (uniformity of the spring force in the relevant deformation range), a bending spring is to be used with less pre-curvature, i.e. fewer windings, then the cross-sectional surface area of the strand material of the bending spring has to be modified with respect to the pivot axis of the levers to be pivoted by the bending spring, namely such that, with respect to said axis, the radial dimension becomes smaller and the axial dimension increases. For example, instead of round material, it is then possible to use flatter, broader material as the strand material of the bending spring. Depending on the material of the bending spring, there is a lower limit to which the number of windings can be reduced for this adaptability, especially for reasons relating to manufacturing technology and for reasons of space. In the case of spring steel as the material, this lower limit of the number of windings is in the range of one to two windings.

The first choice for the material of the bending spring (i.e. of the elastically prestressed part 14) is certainly spring steel. However, with suitably adapted dimensions, it is also possible to use materials that are not so advantageous as spring steel in terms of elasticity properties (elastic deformation range, creep resistance, fatigue resistance) and elastic modulus. As regards the pivot axis of the levers, the axial dimension on the cross-sectional surface area of the strand material of the bending spring has to be increased and, if appropriate, the radial dimension reduced and the number of windings increased.

If a bending spring according to the invention is used as elastically prestressed part 14, i.e. a bending spring which is pre-curved by more than 360° and accordingly has such a flat spring characteristic that the force with which the levers clamp the tragus 2 between them when operating as intended is approximately constant in the relevant angle range, then the levers do not necessarily have to be two-armed as shown in the drawings in FIG. 2 to FIG. 6.

Figure 7:
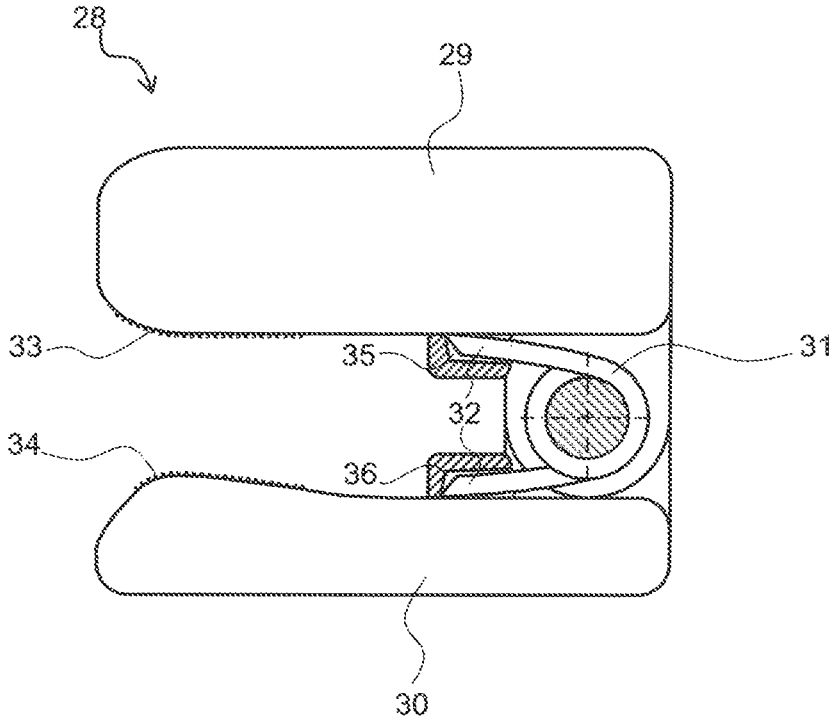
FIG. 7 shows a fourth example of a device according to the invention, in a partial sectional view from above or below.

FIG. 7 shows a design of a device 28 according to the invention in which the levers 29, 30, pivotable relative to each other in order to clamp the tragus between them, are one-armed levers. In this case, the lever 29 intended to be arranged on the inner face of the tragus also forms the housing for functional parts that are to be arranged in the device 28, in particular for an earphone.

In the same way that a paper clip can be pushed onto the margin of a sheet of paper, parallel to the plane of the paper, the device 28 can be pushed onto the tragus, which after all has roughly the shape of a flat surface too, and it can also be removed therefrom again by movement in the opposite direction.

By virtue of the elastically prestressed part 31 designed according to the invention as a bending spring with a greater than 360° pre-curvature, the pressing force exerted by the levers 29, 30 on the tragus is so low that no painful rubbing occurs, even though the device 28, once fitted, is held securely on the tragus.

Taking the example according to FIG. 7, the bending spring formed by the elastically prestressed part 31 is dimensioned, arranged and elastically prestressed in such a way that it pulls on the levers 29, 30 with its branches 32, with the result that, in the absence of other forces, the regions of contact 33, 34 on the levers 29, 30 are moved toward each other until they either bear with pressure on each other or on a body located between them, typically a tragus. To ensure that the branches 32 can exert a tensile force on the levers 29, 30, each of the two branches 32 engages in a pocket-like hollow space 35, 36 on each lever 29, 30, respectively.

Figure 9:
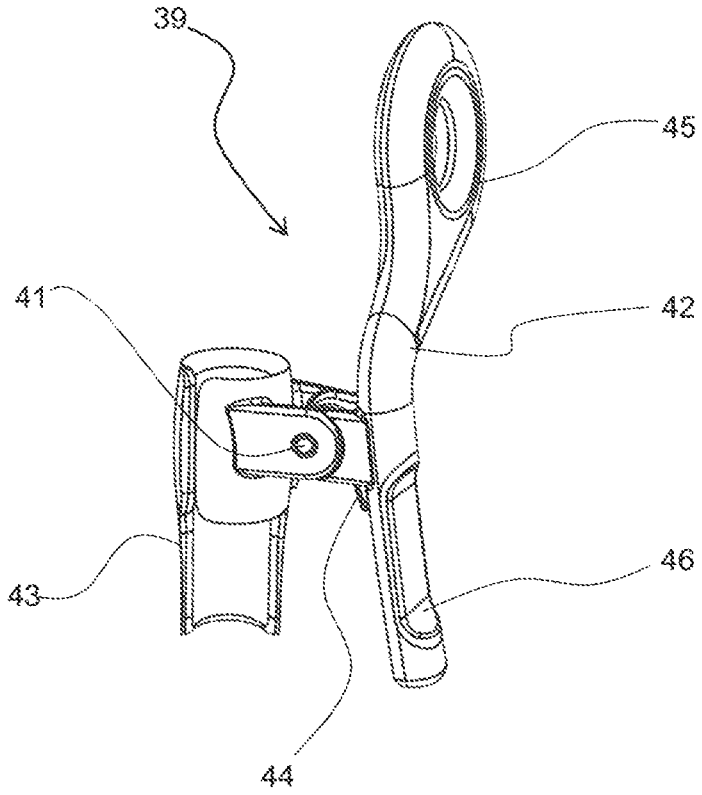
FIG. 9 shows an oblique front view of a part of a fifth device according to the invention.
Figure 10:
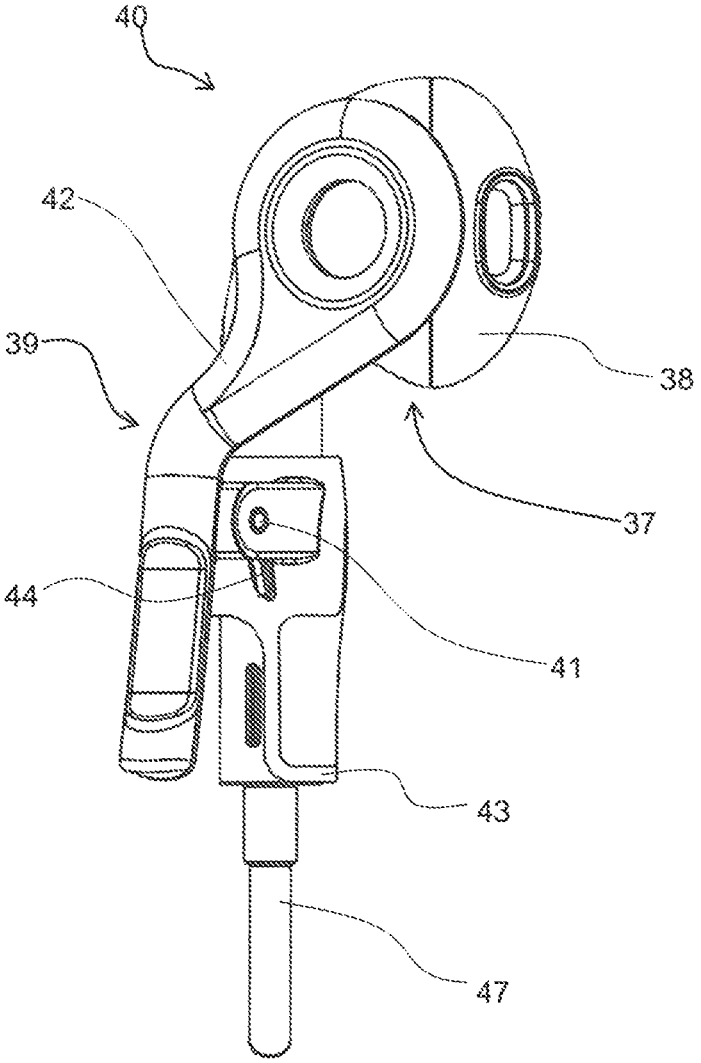
FIG. 10 shows an oblique front view of the device from FIG. 9 as a whole.

FIG. 9 and FIG. 10 illustrate how a device 37 which is in accordance with the design discussed at the onset with reference to documents U.S. Pat. No. 5,222,151 A and JP 9294296 A and which contains an earphone in a housing 38, with the housing 38 inserted as intended between tragus and antitragus, can be supplemented by a holder 39 in order to form a device 40 according to the present invention.

In this connection, FIG. 9 shows the holder 39, which has two levers 42, 43 connected to each other pivotably about a common pivot axis 41, and also an elastically prestressed part 44 which, between the two levers 42, 43, exerts a force by which the latter are driven in a pivoting movement about the pivot axis 41 in the absence of other influences.

One lever 42 is a two-armed lever, of which the upper lever arm 45, when arranged as intended on an ear, comes to bear on the outer face of the tragus and is pressed onto the latter on account of the elastically prestressed part 44.

The second lever 43 is substantially a one-sided lever with respect to the pivot axis 41. It has approximately the shape of a tube, of which the lateral surface is not closed and is instead interrupted by a longitudinal slit.

The device 37 has an extension piece 47 which juts downward from the housing 38, is narrower than the housing 38 and, for example, can be a cable sleeve, or a rod-shaped antenna part. The holder 39 and the device 37 are intended to be connected to each other by means of the extension piece 47 being inserted from above into the lever 43 configured as said tube and being moved in the longitudinal direction until the housing 38 is located at the same height as the intended surface of contact of the two-armed lever 42 with the tragus. Together, the device 37 (which itself can be configured according to the known prior art) and the holder 39 thus once again form a device according to the invention which has two pivotable, interconnected two-armed levers, wherein an earphone is mounted on one lever arm, and wherein the device is secured on an ear by means of the two levers pressing on the tragus 2 from opposite sides.

The lower lever arm 46 of the two-armed lever 42 and the lever 43, which together with the device 37 according to the prior art forms a two-armed lever, are here intended to be moved toward each other in order to release the clamping on the tragus.

The invention claimed is:

1. An earphone device comprising:

an inner lever and an outer lever which are arranged oriented parallel or at an acute angle to each other and are connected to each other pivotably with respect to a pivot axis, wherein the inner lever, when the device mounted on the tragus, is provided to bear on the tragus from the inside via a region of contact lying remote from the pivot axis, and the outer lever, with the device mounted on the tragus, is provided to bear on the tragus from the outside via a region of contact lying remote from the pivot axis, wherein the device is securable on an ear by means of the two levers pressing on the tragus from opposite sides, wherein an elastically prestressed part is in engagement with both levers in such a way that, on account of its elastic prestressing force, it causes a torque between the two levers about the common pivot axis, wherein, the two levers both have two arms, wherein the pivot axis lies at a distance from the ends of both levers in a respective longitudinal direction of the levers and moreover lies outside the normal projection in side view onto the surface of the tragus when the device is fitted on the tragus.

2. The device as claimed in claim 1, wherein the rectilinear continuations, normal to the pivot axis, of the intended regions of contact of the levers with the tragus enclose the pivot axis between them.

3. The device as claimed in claim 1, wherein a distance of at least 1 cm lies between the area centers of the intended regions of contact with the tragus and the pivot axis.

4. The device as claimed in claim 1, wherein the pivot axis lies in front of the tragus margin in the region of the cavum conchae and is oriented at least approximately parallel to the tragus margin.

5. The device as claimed in claim 1, wherein the levers are curved about an axis lying parallel to the pivot axis between the two levers.

6. The device as claimed in claim 1, further comprising an off switch which is configured to switch the device off automatically when the intended regions of contact with the tragus are pivoted toward each other by less than a fixed minimum distance.

7. The device as claimed in claim 1, wherein one of the levers has charging contacts for a rechargeable battery.

8. The device as claimed in claim 1, further comprising a housing containing an earphone, wherein housing is releasably connectable to one of the two levers.

9. The device as claimed in claim 1, wherein the elastically prestressed part is a pre-curved bending spring, which is pre-curved by at least approximately 540°.

10. The device as claimed in claim 1, wherein the elastically prestressed part is a pre-curved bending spring, which is pre-curved by more than 360°.

11. The device as claimed in claim 1, wherein the elastically prestressed part is a pre-curved bending spring, which is pre-curved about the common pivot axis.

* * * * *